United States Patent [19]

Thompson

[11] Patent Number: 4,770,309

[45] Date of Patent: Sep. 13, 1988

[54] CLOSURE CAP WITH A LINERLESS SEAL AND METHOD OF FORMING SUCH CLOSURE AND SEAL

[75] Inventor: Mortimer S. Thompson, Maumee, Ohio

[73] Assignee: Tri-Tech Systems International, Inc., Maumee, Ohio

[21] Appl. No.: 61,118

[22] Filed: Jun. 10, 1987

[51] Int. Cl.[4] ..... B65D 53/00

[52] U.S. Cl. ..... 215/344; 215/DIG. 1; 264/295; 264/296; 264/320

[58] Field of Search ..... 215/344, DIG. 1; 264/295, 296, 320

[56] References Cited

U.S. PATENT DOCUMENTS

| | | | |
|---|---|---|---|
| 3,343,700 | 9/1967 | Heubl | 215/344 X |
| 3,482,725 | 12/1969 | Exton | 215/344 X |
| 4,209,102 | 6/1980 | Dunn et al. | 215/344 X |

*Primary Examiner*—Donald F. Norton

*Attorney, Agent, or Firm*—Hedman, Gibson, Costigan & Hoare

[57] ABSTRACT

In combination, a container and a one piece, linerless cap and a method of forming the cap. The cap includes plastic and has a sealing surface which is softer than contiguous plastic portions as a result of its method of forming which includes stretching. In the method the cap is molded from plastic and includes a top wall and an outer depending skirt. Thereafter the top wall is engaged by a forming tool to create a stretched portion for sealing.

12 Claims, 3 Drawing Sheets

CLOSURE CAP WITH A LINERLESS SEAL AND METHOD OF FORMING SUCH CLOSURE AND SEAL

FIELD OF THE INVENTION

This invention relates to a closure cap with a linerless or integral seal and to a method of and apparatus for forming said closure and seal.

BACKGROUND OF THE INVENTION

The function of a closure cap to adequately seal the contents of a container against leakage from or into the container traditionally has been met by incorporating a soft liner to effect a seal between the under portion of the cap lid and the upper face of the bottle neck rim. The liner may be preformed from sheet or formed in place and is produced from materials or laminar combinations of materials which provide easy cold formability to enable the liner to conform to the individual configuration of the neck rim, including manufacturing aberrations and defects. Because of the specialized sealing function of a liner, it is typically made from softer polymers than those selected to perform the more structural cap functions of providing a strong resilient enclosure for the neck opening with a strong mechanical engagement therewith. In some instances stiffer and stronger polymers, including some which are suitable for producing threaded caps, may be expanded to produce voids and a less dense sheet having a softer, more flexible characteristic and liners may be made therefrom.

An alternative approach in popular use is a laminate of paperboard substrate with a soft sealing surface such as wax or plastic. This approach offers low cost but has performance limitations especially when moisture is present.

Because of an economic advantage, much attention has been devoted to developing caps which have an integral, "linerless" seal. The availability of such semi-rigid plastics as polypropylene and polyethylene, which combine a moderate level of strength and resilience with a moderate level of softness and conformability, has made possible popular use of caps with linerless seals. Typically, such caps employ a circular flange under the cap lid having a wedge shape cross section the lower portion of which is thin and flexible and intended to abut the top surface of the bottle neck rim in a compressive action for sealing. The wedge shape flange generally is vertical and provides a sealing area restricted to the width of the narrower more flexible portion of the wedge shape. For their effective use they depend upon a very high level of sealing force on a very limited sealing area which makes them susceptible to sealing surface imperfections and the decay of sealing force over long time periods.

Other linerless caps employ conical flanges at an angle from the vertical or with quarter-round or claw shape so that capping will cause the flanges to flex and slide out over the top surface or the neck rim thereby creating a somewhat larger sealing area than obtainable with vertical flanges in straight compression. While the larger sealing area has advantages, this is offset by the fact that the sealing pressure is at the same time reduced because of the thinness at the sealing area resulting from the severe tapers in cross section which is normally required. This limitation results from the difficulty of removing such features from an injection mold. This also results in more complex and costly mold construction and operation and also excludes the more rigid plastics from use.

Still other linerless caps employ conical flanges which engage the corners of the neck rim with the underside of the flange. Such features rely on the use of very high sealing pressure directed against a restricted contact at the rim corners to obtain sealing integrity. In such cases sealing integrity depends on container rim corners which are without blemishes as produced and which, because they are most susceptible to marring during handling, must be suitably protected from such before they are capped and sealed. Also, to the extent that the conical flanges approach the shape of a cylinder, their sealing integrity is affected by out-of-round or other common dimensional variations of the container manufacturing process or variations between manufacturers resulting from the fact that inside neck dimensions typically are not specified. And to the extent that the flanges become more conical, more complex and costly mold construction and operation result.

Still another type of linerless cap employs a plug configuration in sealing contact with the inside wall of the container neck. This type of seal has the advantage of engaging that surface of the bottle neck which may be freest from manufacturing defects and most protected from incidental marring in handling thereafter. However, wide manufacturing dimensional tolerances and the industry-wide practice of not specifying the neck bore dimension impose severe limitations in trying to obtain consistent sealing engagement and integrity. As a result, resistance to tapered plug seals can push the cap lid up to varying degrees of undesirable dome shapes. Or such plug seals can yield unacceptably wide variations in sealing engagement and pressures. Efforts to overcome such deficiencies have led to proposed designs with flanges extending radially from generally cylindrical plugs wherein the outer rim of the flange makes a narrow sealing contact with the neck bore and is supported by a cantilevered flexing action. (See, for example, U.S. Pat. Nos. 4,090,631, 4,016,996 and 4,210,251). An additional problem has been encountered with this type of linerless seal in that the lip or rim of the flange may be distorted by the neck rim during capping leading to imperfect seals. Efforts to eliminate this problem can introduce other problems specific to pressurized containers wherein blow-off or missiling of the caps can occur during uncapping. Another effort to avoid distortion of the lip or rim of such a seal is a cap design and method of producing it wherein a radially extending flange having a downward orientation as molded is hingedly "bent", "folded", or inverted into an upward orientation before it is applied to the container where sealing occurs at or adjacent the rim of the inverted flange portion and, importantly, not at the hinge U.S. Pat. No. 1,024,76.) This is accomplished with extra mold portions and actions during part removal or subsequently in an appropriate fixture to hingedly invert the flange. This effort, therefore, requires the molding of a seal of complex shape utilizing a complicated and costly mold construction and molding operations followed by inverting the sealing portion of the seal hingedly to alter its orientation but not its shape.

Importantly, in all cases an inherent limitation to heretofore available linerless caps is that the sealing surface has the same plastic in the same physical state as the structural portion of the cap. This has called for a compromise in the softness and conformability of the sealing surface or in the strength of the structural cap portions, or most frequently both, with consequent limitations in the cap usefulness. That is, to achieve a softer more conformable seal, poorer thread strength must be accepted or to achieve greater thread strength, a harder, less conformable seal must be accepted.

Thus, known caps with linerless seals are beset with drawbacks and problems associated with their need to perform with container necks having imperfect sealing surfaces and wide dimensional tolerances; their limited sealing integrity based on restricted sealing area; the face that sealing surface softness and conformability are limited; the fact that the use of more rigid plastics are not feasible; and the higher cost and complexity of mold construction and operation for a number of the proposed sealing designs.

SUMMARY OF THE INVENTION

In accordance with the present invention, there is provided a new and unique cap with a linerless or integral seal which develops a positive sealing pressure and engagement with a container opening upon closing the container. The cap is substantially rigid and includes plastic material and has a top wall or lid which covers the container opening. The cap has a depending skirt which engages the finish of a container or bottle for closing thereof. The seal is made from plastic and is integral with the top wall of the cap. The seal preferably is internally spaced from the peripheral skirt and includes a highly compressible sealing portion which has a conformable surface produced by stretching which is relatively softer than its contiguous unstretched portions. As the cap is applied to the container for closing, the seal engages the container finish and readily compresses to provide a relatively large sealing area to seal the contained product.

In a preferred embodiment, the linerless seal includes a substantially annular upper portion integral with and depending from the lid and a substantially annular highly compressible embossed lower portion which has a "U" or "V" shape cross section. The embossed lower portion has a sealing surface which is softer than the rest of the cap as a result of its method of manufacture which includes stretching it.

The stretched linerless seal preferably has balanced residual strain wherein the sealing surface is in a state of tension and relatively soft and compressible and the substrate or supporting structure is in a balancing state of compression and relatively hard and resistant to compression and which maintains the state of tension and relative softness of the opposing sealing surface.

In another preferred embodiment the linerless sealing surface is relatively softer than the other cap portions as a result of altering it to include microscopic voids which soften it and make it less dense and more compressible by employing plastics of the invention which exhibit this characteristic when stretched.

In one preferred method of forming the cap and integral embossed seal of the invention, the cap may be molded by conventional molding techniques, such as injection or compression molding, with a lid of essentially uniform thickness having an annular U or V shape projection on its upper surface and an opposing U or V shape groove on its lower surface so that it is configured as an annular U or V shape pleat or fold. The U or V shape fold is then inverted with suitable tools to produce the annular embossed linerless seal on the lid's lower surface. The stresses imposed on the plastic by this operation stretches and thereby softens the plastic on its lower, sealing surface while the sealing substrate or supporting portion is compressed and placed into a balancing state of compression to maintain the stretched and softened condition of the sealing surface. Optionally the cap may be made from a plastic of the invention so that the stretched sealing surface also includes residual microscopic voids which further soften it.

In still another method of forming the cap and integral embossed seal of the invention the cap may be molded with a lid having a solid annular projection on its upper surface. The projection is then compressed into the lid thereby expressing an annular U shape sealing projection on the lower lid surface. The stresses imposed on the plastic by this operation stretches and thereby softens the plastic on the surface of the lower sealing projection while its substrate or supporting portion is placed into a balancing state of compression to maintain the stretched and softened condition of the sealing surface. Optionally the cap may be made from a plastic of the invention so that the stretched sealing surface also includes residual microscopic voids which further soften it.

In still another method of forming the cap and integral embossed seal of the invention, the cap may be molded with a flat lid of essentially uniform thickness and the lid shape may be altered by employing embossing tools to include an annular downward U or V-shape projection. The stresses imposed on the plastic by this embossing operation stretches the plastic beyond its tensile yield point to produce microscopic voids which soften the sealing surface and make it more conformable. Optionally the cap can be made from a plastic which does not produce microvoids when stretched and the softness of the sealing surface then depends on the tensile strain produced and maintained by a balancing compressive strain.

To facilitate the embossing operation or to alter the dimensions, shape or character of the resultant linerless seal, the linerless seal preform or the embossing tool may be heated. The tool may be used in straight compression with the cap lid, with or without spinning, or it may be rolled along it to produce the linerless seal of the invention. The cap lid may also be reformed or embossed simultaneously or sequentially.

A feature of the invention is that very high degrees of softness can be achieved for linerless cap sealing surfaces without compromising the strength and rigidity characteristics of the remainder of the cap including threaded portions.

Another feature of the invention is that significant depths of softness can be achieved at the sealing surface to assure high sealing performance on container sealing surfaces having significant imperfections.

Another feature of the invention is that the sealing portion can have a surface of the highest levels of softness with progressively lower levels of softness and higher levels of resilience in the substrate, thereby offering a higher level of sealing performance under more challenging conditions of temperature and/or pressure differentials than sealing portions with uniform softness throughout.

Still another feature of the invention is its low cost manufacturing methods using low cost molds and molding operations and low cost reforming machinery and operations.

BRIEF DESCRIPTION OF THE DRAWINGS

The following is a detailed description together with accompanying drawings of illustrative embodiments of the invention. It is to be understood that the invention is capable of modification and variation to those skilled in the art within the spirit of the invention.

FIG. 9 after embossing) and what occurs to the microscopic voids upon sealing engagement with a container (FIG. 10).

DETAILED DESCRIPTION OF THE INVENTION

Figure 1:
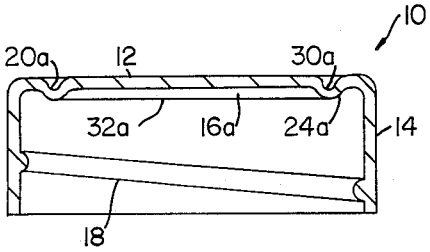
FIG. 1 is longitudinal sectional view of one embodiment of the embossed linerless cap of the invention.
Figure 2:
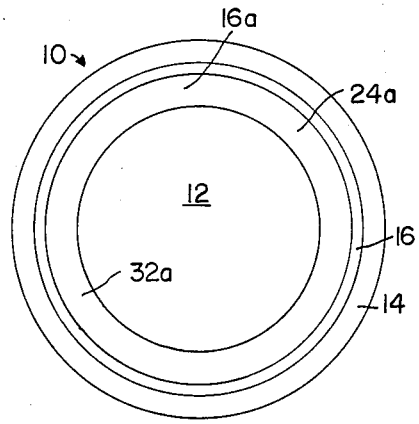
FIG. 2 is a bottom plan view of the linerless cap of FIG. 1.
Figure 3:
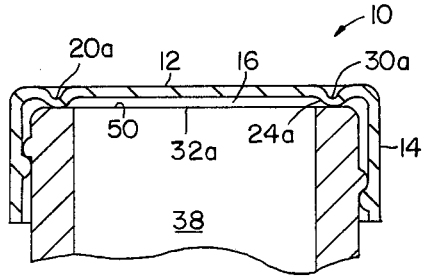
FIG. 3 is longitudinal sectional view of the linerless cap of FIG. 1, wherein the cap has closed a bottle with the embossed seal of the invention in sealing engagement with the rim of the bottle neck.

Referring to FIGS. 1 to 3, there is shown a semirigid, threaded, plastic cap 10, having a lid 12, a depending peripheral internally threaded skirt 14 and an internal integral or linerless seal 16*a*. The illustrated integral seal 16*a* includes a generally "U" shape annular projection 24*a* on the lower surface of the lid 12 and an annular groove 20*a* on the top surface of the lid 12. The projection 24*a* has a lower surface 32*a* for sealing and an opposing upper surface 30*a*. The sealing surface 32*a* is softer than contiguous portions of the cap 10 as a result of the method of its production which stretches it. FIG. 3 shows the cap 10 and its linerless seal 16*a* in sealing engagement with the rim 50 of a container neck 38.

Figure 4:
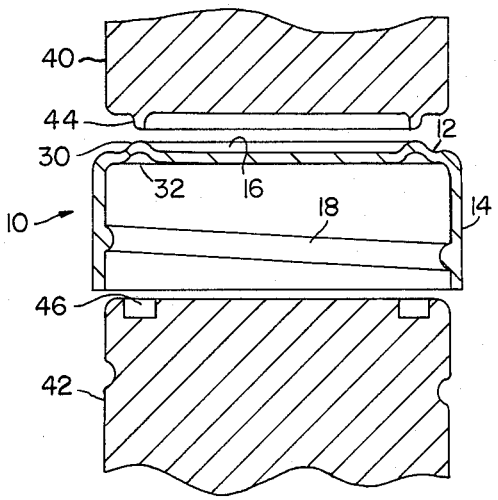
FIG. 4 is a longitudinal sectional view of the cap of FIG. 1 after molding and including a preform for the seal which is about to be engaged by an embossing tool of the invention.
Figure 5:
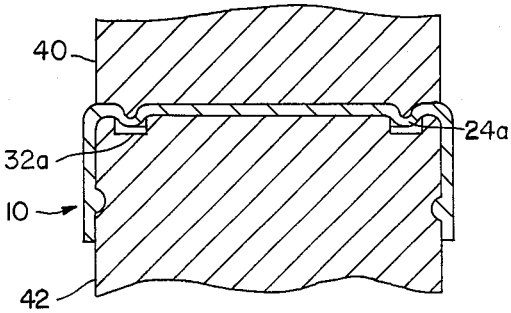
FIG. 5 generally is the same as FIG. 4, except that the embossing tool has engaged the top wall of the cap and inverted it to form the embossed plastic seal of the invention.

Referring now to FIGS. 4 and 5, there is shown a method of using inverting/embossing tools 40 and 42 to produce the linerless seal 16*a* of FIGS. 1 to 3 by inverting a portion of the cap lid 12 to form an annular inner protuberance or raised portion 24*a*. FIG. 4 shows the cap 10 as molded with a lid 12 including an upper annular projection 16 defined by the upper convex surface 30 and the lower opposing concave surface 32 positioned between the upper inverting/embossing tool 40 and the lower inverting/embossing tool 42 prior to inversion. The upper embossing tool 40 includes an annular projection 44 and the lower embossing tool includes an annular recess 46. FIG. 5 shows the upper and lower embossing tools 40 and 42 fully engaged in compression wherein the upper lid projection 16 has been inverted to form the linerless seal 16*a* with its lower projecting surface 32*a*. In accomplishing the inversion, the original lower concave surface 32 of lid 12 is stretched significantly to become the lower projecting surface 32*a* and is thereby softened while the original upper projecting surface 30 of the lid 12 is significantly compressed when it is inverted to become the upper concave surface 30*a* to thereby balance and maintain the state of tension and resultant softness at the projecting sealing surface 32*a*.

To facilitate the embossing operation, in the case of polypropylene, the tools 40 and 42 may be at a temperature of about ambient to about 300 degrees F. but preferably about ambient to about 150 degrees F. for embossing cycles of about one-half to two seconds. Also the cap may be heated in the same temperature range before embossing for the same purpose. Lower temperatures are preferred to maximize the desired strain of the invention imposed by the embossing operation on the plastic of the embossed portion 24*a* as discussed hereinafter with respect to FIGS. 6 to 10.

The preferred embossing method of the invention illustrated by FIGS. 4 and 5 not only produces the linerless seal 16*a*, but in addition it modifies the physical properties of the plastic in such a way as to further enhance its sealing characteristics. That is, the plastic at the sealing surface of the seal 16*a* is made softer and more comformable and at the substrate and supporting portions is made stronger, more resilient and creep resistant as a result of the stresses imposed on the plastic during the embossing operation. This enhancement will now be explained in reference to FIGS. 6 and 7.

The embossing operation, by imposing an alternative inverted shape on the preform upper projection 16 also imposes balanced residual stresses and stress differentials to the resultant shape, lower projection 24*a*, in the seal 16*a*. The lower concave surface 32 (before inversion) is stretched to become the lower projecting sealing surface 32*a* and is in extension or a state of tension. Its opposing upper surface 30 (before inversion) is compressed to become the upper concave surface 30*a* of seal 16*a* and is in a state of compression. The level of stress varies with the degree of extension or compression and, as in any static condition, the total amount and direction of each kind of stress balances and maintains the other.

Figure 6:
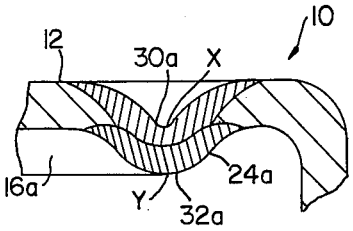
FIG. 6 is an enlarged sectional view of a portion of the embossed seal and adjacent portions of the cap of the invention schematically illustrating the stresses produced in the seal upon embossing.
Figure 7:
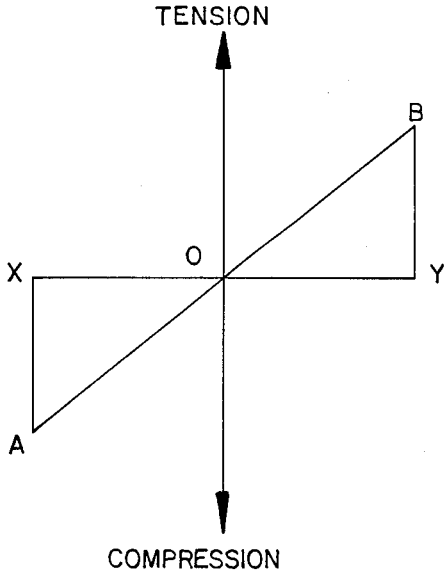
FIG. 7 is a graft schematically illustrating the balance of stresses produced in the seal upon embossing.

The balanced residual stresses occur in the radial direction as a result of the inversion/embossing method of the invention with the extension and compression of the preform upper projection 16 across its thickness to form the lower sealing projection 16*a* as shown in FIG. 6. At and near the convex lower sealing surface 32*a* represented by point Y the plastic is stretched in the radial direction and is in a state of residual tension. The opposite concave surface, represented by point X is compressed in the radial direction and is in a state of residual compression which balances and maintains the state of tension at or near the exterior convex surface. FIG. 7 shows the direction, sum and approximate distribution of these stresses across the thickness of the plastic including the neutral point 0 and points of maximum compression and tension at or near the upper and lower surfaces. In the normal practice of the invention maximum tensile stress will occur over a finite distance from the surface. The sum of the compressive stress defined by points AOX equals that of the tensile stress defined by the points BOY. The high state of tension at point Y and the remainder of the sealing surface 32*a* weakens it and makes it softer in that a much lower level of added tension is required to reach and exceed its yield point where deformation is easily achieved. In this regard, a normally stiffer and stronger plastic behaves like a softer and weaker plastic. In the same manner the high state of compression at point X makes the plastic there stiffer, stronger and more creep resistant.

Figure 8:
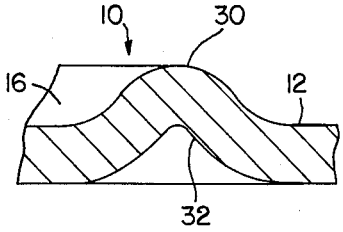
FIGS. 8–10 are enlarged sectional views of a portion of the embossed seal of the invention schematically illustrating what occurs in the embodiment of the invention wherein a plastic is used which produces microscopic voids upon embossing (FIG. 8 prior to embossing.
Figure 9:
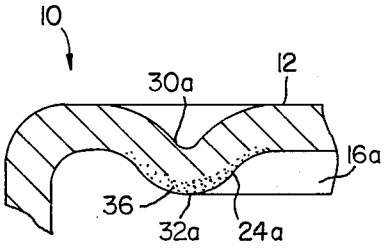
Figure 10:
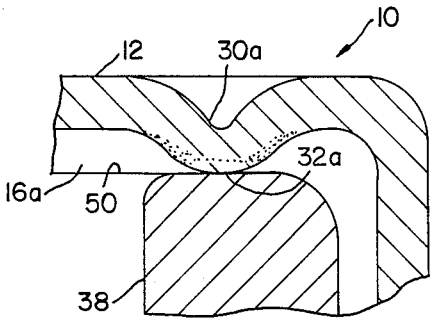

Referring to FIGS. 8 to 10, there is shown a feature of the invention wherein the sealing surface is softened as a result of the production of microscopic voids thereat by employing plastics which form such voids upon stretching. FIG. 8 shows the upper projection 16 integral with lid 12 prior to inverting/embossing as illustrated by FIG. 4. FIG. 9 shows the lower sealing projection 24*a* including microscopic voids 36 produced during the embossing operation which preferably is done at or near ambient temperatures to facilitate the creation of the voids. The size and/or number of the voids are in relationship to the degree to which the plastic has been stretched. FIG. 9 shows that the void formation is greater where the plastic has been stretched most at the lower sealing surface 32*a*. FIG. 10 shows the seal 16*a* employed as a rim seal against the rim 50 of neck 38 and the compression of the sealing surface 32*a* by such sealing engagement with the resultant elimination of the voids in the seal area.

Thus, it can be seen that the embossing process of the invention used to create a desired shape for superior sealing performance also modifies the physical properties of the plastic at the sealing surface from those of a more rigid, unyielding material suitable for overall cap strength and integrity to those of a softer, more yielding and conformable material suitable for improved sealing characteristics.

Figure 11:
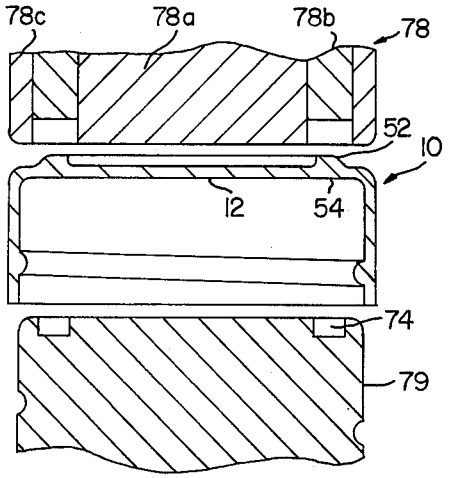
FIGS. 11–13 are longitudinal sectional views of another embodiment of the method of the invention for producing embossed seals in a molded cap.
Figure 12:
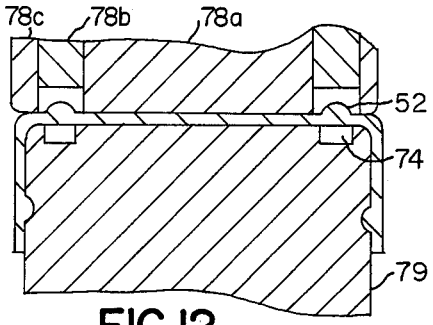
Figure 13:
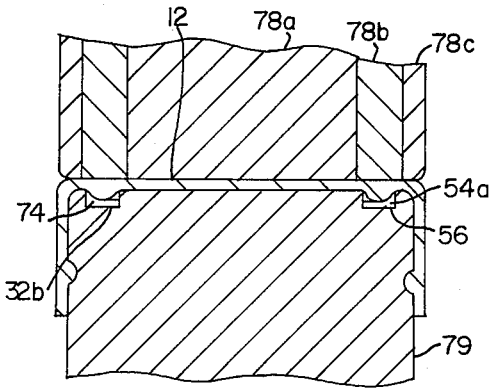

Referring to FIGS. 11 to 13 there is shown another embossing embodiment of the invention and a method used for its production. FIG. 11 shows a cap 10 as molded having a lid 12 including an upper annular projection 52 and its opposing lower surface 54 positioned between an upper embossing tool 78 and a lower embossing tool 79. The upper embossing tool 78 includes an inner cylindrical component 78*a*, an outer concentric component 78*c* and an intermediate concentric component 78*b*. The lower embossing tool 79 includes an annular recess 74. FIG. 12 shows the embossing tools 78 and 79 in partial engagement placing the cap lid 12 under compression between upper embossing tool components 78*a* and 78*c* and lower tool 79. FIG. 13 shows the embossing tools 78 and 79 in completed engagement wherein upper tool component 78*b* compresses the lid 12's upper annular projection 52 so that the lid 12's lower surface 54 thereunder is expressed into the annular recess 74 of lower embossing tool 79 to produce the raised annular protuberance 56 of the linerless seal 16*b* having a stretched and softened sealing surface 54*a*. The material originally in projection 52 has been displaced into the horizontal portion of lid 12 and is under significant compression which balances and maintains a significant state of tension and resultant relative softness in the linerless sealing surface 54*a*. Additional softness can be produced at the sealing surface 54*a* through the use of plastics of the invention which produce microscopic voids upon being stretched.

Figure 14:
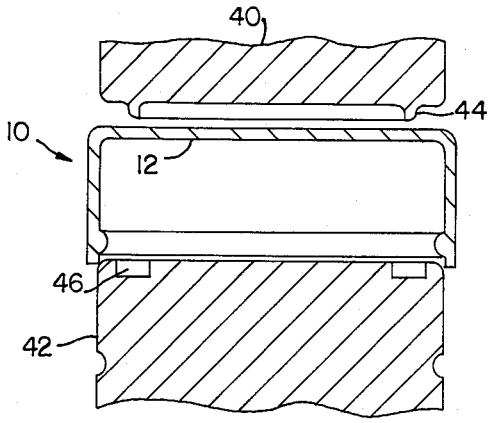
FIGS. 14–15 are longitudinal sectional views of a further embodiment of the method of the invention for producing embossed seals in a molded cap.
Figure 15:
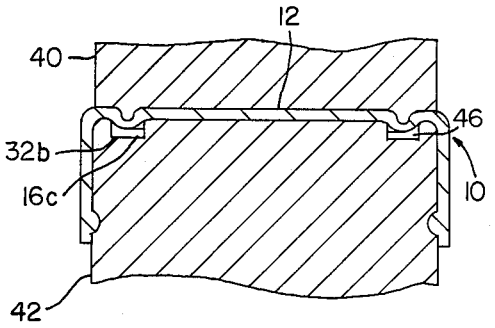

FIGS. 14 and 15 illustrate another embossing method used to produce a linerless seal of the invention by embossing a portion of the cap lid. FIG. 14 shows the cap 10 as molded with a flat lid 12 positioned between the upper embossing tool 40 and the lower embossing tool 42 of FIGS. 4 and 5 prior to embossing. The upper embossing tool 40 has an annular projection 44 and the lower embossing tool 42 has an opposing annular recess 46. FIG. 15 shows the upper and lower embossing tools 40 and 42 fully engaged in compression of the lid 12 thereby producing the linerless seal 16*c* with its sealing surface 32*b* in a state of tension by expressing a portion of lid 12 into the annular recess 46 of the lower embossing tool 42. The annular recess 46 is preferably large enough and of such dimensions that the lower sealing surface 32*b* of the linerless seal 16*c* is not compressed by the tool engagement so that its maximum state of tension and production of microscopic voids with resultant softness can be achieved.

Useful plastics which can be used for forming the caps and linerless seals of the invention include polypropylene, polyethylene, polystyrene, acrylonitrile - styrene - butadiene polymers, an other semi-rigid to rigid plastic materials. In addition, plastics employed in the practice of the invention can be chosen from the group of plastics which have in common the fact that when stretched beyond their tensile yield point they develop microscopic voids or fissures within the plastic which serve to soften it and make it more compressible, even when residual tensile strain is not present. The group of plastics manifesting this behavior includes essentially all polymer classes (e.g., polystyrene, polyvinyl chloride, polyolefins, polycarbonates, polysulfones, polyesters, nylons, etc.) and preferably are selected from the group of plastics known as alloys, blends, multipolymers, multiphase polymers or other nomeclatures, many of which are listed in Modern Plastics Encyclopedia, 1986–1987, pages 105 to 111, the entire disclosure of which is incorporated herein by reference. Examples of such polymers are propylene copolymers (e.g., Shell 7522), ethylene-propylene copolymer (e.g., Himont SB781) and rubber modified polystyrene (e.g., Monsanto Lustrex 4300). Typically the Shell 7522 propylene copolymer produces upon stretching microscopic voids in the range of about 0.25 microns to about 3.0 microns.

The linerless seals of the present invention can be used in a wide variety of caps such as continuous or discontinuous thread, snap, vacuum, dispensing and child resistant caps and can include combinations with other materials (e.g., caps having metal lid portions or portions utilizing different plastic than that used for the seal). Such linerless seals may be used to close and seal a wide variety of containers for a wide variety of products including: beverages, including carbonated soft drinks and pasteurized beverages such as beer; foods, especially those where container sealing performance is critical, including oxygen sensitive ones such as mayonnaise, peanut butter and salad oil, and including corrosive ones such as vinegar, lemon juice; and household chemicals, including bleaches and detergents, drugs and cosmetics and other products requiring the highest integrity seal and reseal under the widest range of distribution and use conditions.

Further, the linerless seals of the present invention can be used in conjunction with other types of linerless seals including other type seals of the invention and may employ various or all surfaces on or about the neck rim 40.

Cap sizes may typically range from under 20 mm to 120 mm and bottle and/or jar sizes range from under 2 ounce to 128 ounce capacity. Larger capacity containers such as drums or kegs are also suitable for the practice of the invention as are smaller vials and other containers.

I claim:

1. A method of forming a linerless cap including a seal, comprising:

molding a cap from plastic having a top wall, and engaging a portion of said top wall with an embossing tool to emboss said engaged portion into an integral plastic seal within said cap having an inner, stretched sealing surface which is softer than its contiguous unstretched portions and which upon engagement is adapted to compress and seal.

2. The method of claim 1, wherein said embossing tool embosses said plastic seal into an annular configuration having a U or V cross-sectional shape.

3. The method of claim 1, wherein said stretched, softened sealing surface is in a state of tension.

4. The method of claim 1, wherein said stretched, softened, sealing surface includes microscopic voids.

5. The method of claim 1, wherein said stretched, softened, sealing surface is in a state of tension and includes microscopic voids.

6. A cap formed by the method of claim 1.

7. A linerless cap for a container, comprising a top wall including an embossed plastic seal integral with and depending from said top wall and within said cap having an inner stretched, sealing surface which is softer than its contiguous unstretched portions and which upon engagement is adapted to compress and seal.

8. The cap of claim 7, wherein said embossed plastic seal is annular in configuration and has a U or V cross-sectional shape.

9. The cap of claim 7, wherein said stretched, softened, sealing surface is in the state of tension.

10. The cap of claim 7, wherein said stretched, softened, sealing surface includes microscopic voids.

11. The cap of claim 7, wherein said stretched, softened, sealing surface is in a state of tension and includes microscopic voids.

12. The cap of claim 7 in combination with a container.

* * * * *